US008511667B2

(12) United States Patent
Kuo

(10) Patent No.: US 8,511,667 B2
(45) Date of Patent: Aug. 20, 2013

(54) AUTOMATIC DOCUMENT FEEDER

(75) Inventor: Ping-Hung Kuo, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/364,968

(22) Filed: Feb. 2, 2012

(65) Prior Publication Data

US 2013/0119598 A1 May 16, 2013

(30) Foreign Application Priority Data

Nov. 11, 2011 (TW) ..... 100141305 A

(51) Int. Cl.
*B65H 5/00* (2006.01)

(52) U.S. Cl.
USPC ... 271/10.13; 271/4.01; 271/4.04; 271/10.01; 271/10.04; 271/10.09; 271/10.11

(58) Field of Classification Search
USPC ..... 271/4.01, 4.04, 4.1, 10.01, 10.04, 271/10.09, 10.11, 10.13
See application file for complete search history.

(56) References Cited

U.S. PATENT DOCUMENTS

| | | | | |
|---|---|---|---|---|
| 4,927,130 | A * | 5/1990 | Tanaka et al. | 271/10.11 |
| 5,141,217 | A * | 8/1992 | Lim et al. | 271/10.13 |
| 7,441,763 | B2 * | 10/2008 | Su | 271/10.11 |
| 7,694,954 | B2 * | 4/2010 | Lee | 271/117 |
| 7,770,881 | B2 * | 8/2010 | Yokemura et al. | 271/10.13 |
| 8,342,500 | B2 * | 1/2013 | Katayama | 271/4.01 |
| 2003/0184000 | A1 * | 10/2003 | Kim | 271/10.11 |
| 2003/0209849 | A1 * | 11/2003 | Lee et al. | 271/10.04 |
| 2005/0104273 | A1 * | 5/2005 | Kim | 271/10.01 |
| 2012/0161382 | A1 * | 6/2012 | Morinaga et al. | 271/10.01 |

* cited by examiner

*Primary Examiner* — Prasad Gokhale
(74) *Attorney, Agent, or Firm* — Kirton McConkie; Evan R. Witt

(57) ABSTRACT

An automatic document feeder includes a paper pick-up device, a first roller assembly, and a second roller assembly. The first roller assembly includes a first shaft, a first roller, and a power coupling device. When the power coupling device is connected with the first shaft and the first roller for transmitting a paper, the first roller is driven to be rotated by the first shaft. When the front edge of the paper is moved to the second roller assembly, the first roller is driven to be rotated at a higher speed by the paper. Consequently, a power connection between the first roller and the first shaft is released by the power coupling device. Then, the first roller reaches a static status in order to correct the skew phenomenon of the next paper.

10 Claims, 14 Drawing Sheets

AUTOMATIC DOCUMENT FEEDER

FIELD OF THE INVENTION

The present invention relates to an automatic document feeder, and more particularly to an automatic document feeder with a function of correcting a skewed paper.

BACKGROUND OF THE INVENTION

For facilitating the user to print or scan a large number of papers, an office machine (e.g. a printer, a scanner or a multifunction peripheral) is usually equipped with an automatic document feeder. By means of the automatic document feeder, a stack of papers can be successively fed into the office machine without the need of using the man power. Consequently, the papers can be printed, scanned or processed at a fast speed and in a labor-saving manner.

However, if the paper is not exactly placed on the inlet tray of the automatic document feeder in the beginning, the paper is aslant fed into the internal portion of the office machine. Under this circumstance, the printing or scanning quality of the office machine is deteriorated, and the paper is readily jammed in the automatic document feeder. The jammed paper becomes hindrance from performing the subsequent tasks. For preventing the skewed paper from being fed into the office machine through the automatic document feeder and obviating erroneous operations of the office machine, an automatic document feeder with a function of correcting a skewed paper was disclosed. Please refer to FIG. 1, which schematically illustrates a conventional automatic document feeder.

As shown in FIG. 1, the conventional automatic document feeder 10 comprises a paper pick-up device 11 and a transfer roller assembly 12. The paper pick-up device 11 comprises a pick-up roller 111 and a separation roller 112. The pick-up roller 111 is used for transporting a paper S into the internal portion of the automatic document feeder 10. The separation roller 112 is located downstream of the pick-up roller 111 for providing a friction force to separate the paper S, thereby preventing a plurality of papers S from being simultaneously transmitted into the automatic document feeder 10.

Please refer to FIG. 1 again. The transfer roller assembly 12 is located downstream of the paper pick-up device 11. In addition, the transfer roller assembly 12 comprises a shaft 121 and a roller 122. The shaft 121 is connected to a power source (not shown). The roller 122 is sheathed around and connected with the shaft 121. Consequently, the roller 122 is synchronously rotated with the shaft 121. Whereas, in a case that the shaft 121 is in a static status, the roller 122 is also in the static status.

When the pick-up roller 111 of the paper pick-up device 11 is rotated and contacted with the paper S, the paper S is transmitted to the separation roller 112 to be separated. The subsequent actions of the conventional automatic document feeder 10 will be illustrated with reference to FIG. 2. FIG. 2 schematically illustrates the actions of the conventional automatic document feeder.

As shown in FIG. 2, when the paper S transmitted through the separation roller 112 is moved to the transfer roller assembly 12, the shaft 121 and the roller 122 of the transfer roller assembly 12 are in the static status in order to hinder the paper S from being continuously advanced. Meanwhile, the paper S is continuously transmitted into the automatic document feeder 10 by the paper pick-up device 11, which is located upstream of the transfer roller assembly 12. Consequently, the front edge of the paper S is moved to the static roller 122 and slightly upturned. After the front edge of the paper S is completely moved to the roller 122, the function of correcting the skewed paper S is achieved.

After a preset time period, the front edge of the paper S is completely moved to the roller 122, and the function of correcting the skewed paper S is achieved. Then, the shaft 121 of the transfer roller assembly 12 acquires the electric power again to drive rotation of the roller 122. Consequently, the paper S is allowed to be transmitted through the transfer roller assembly 12.

Although the conventional automatic document feeder 10 is effective to correct the skewed paper S, there are still some drawbacks. For example, for correcting the skewed paper S by the conventional automatic document feeder 10, the rotation of the shaft 121 is an important factor for determining whether the paper S is continuously advanced or not. As previously described, the paper S is hindered by the static shaft 121 until the front edge of the paper S is completely moved to the roller 122. Once the front edge of the paper S is completely moved to the roller 122, the shaft 121 starts to rotate again. However, it takes a time period to accelerate the shaft 121 from the static state to a normal speed. Since each of the papers S to be transmitted needs the accelerating process, if a large number of papers are frequently processed by the conventional automatic document feeder 10, the paper-feeding efficiency is impaired and the processing time is largely prolonged.

SUMMARY OF THE INVENTION

The present invention provides an automatic document feeder with a high paper-feeding efficiency.

In accordance with an aspect of the present invention, there is provided an automatic document feeder. The automatic document feeder includes a paper pick-up device, a first roller assembly, and a second roller assembly. The paper pick-up device is used for transmitting a paper into the automatic document feeder. The first roller assembly is located downstream of the paper pick-up device for transmitting the paper. The first roller assembly includes a first shaft, a first roller, and a power coupling device. The first shaft is rotated at a first speed. The first roller is sheathed around the first shaft for transmitting the paper. The power coupling device is located at a side of the first roller. The second roller assembly is located downstream of the first roller assembly for transmitting the paper. The second roller assembly includes a second shaft and a second roller. The second roller is sheathed around the second shaft, and driven to be rotated at a second speed by the second shaft, thereby transmitting the paper. When the power coupling device is connected with the first shaft and the first roller, the first roller is driven to be rotated at a third speed by the first shaft, so that the paper is transmitted to the second roller, wherein the third speed is lower than the second speed. When a front edge of the paper is moved to the second roller and the paper has not been completely departed from the first roller, the first roller is driven to be rotated at the second speed by the paper, so that a power connection between the first roller and the first shaft is released by the power coupling device. After the paper is completely departed from the first roller and during the power connection between the first shaft and first roller is established again, the first roller reaches a static status.

In an embodiment, the power coupling device is a one-way clutch.

In an embodiment, the one-way clutch has a first engaging part, and the first roller has a second engaging part, wherein the first engaging part and the second engaging part are engaged with each other.

In an embodiment, the one-way clutch has a first engaging part, and the first shaft has a second engaging part, wherein the first engaging part and the second engaging part are engaged with each other.

In an embodiment, the one-way clutch includes a bearing and a spring. A first end of the spring is connected with the bearing, and a second end of the spring is connected with the first roller.

In an embodiment, the one-way clutch includes a bearing and a spring. A first end of the spring is connected with the bearing, and a second end of the spring is connected with the first shaft.

In an embodiment, the first shaft has a protrusion structure, and the power coupling device has a concave structure. The protrusion structure is accommodated within the concave structure.

In an embodiment, the protrusion structure is a protruding post.

In an embodiment, the protrusion structure is integrally formed with the first shaft.

In an embodiment, the protrusion structure is inserted in the first shaft.

In an embodiment, the concave structure has a slot.

In an embodiment, the concave structure has a notch.

In an embodiment, the concave structure has a beveled guiding surface.

In an embodiment, the first roller has a protrusion structure, and the power coupling device has a concave structure. The protrusion structure is accommodated within the concave structure.

In an embodiment, the protrusion structure is a protruding post.

In an embodiment, the protrusion structure is integrally formed with the first roller.

In an embodiment, the protrusion structure is inserted in the first roller.

In an embodiment, the concave structure has a slot.

In an embodiment, the concave structure has a notch.

In an embodiment, the concave structure has a beveled guiding surface.

In an embodiment, the paper pick-up device comprises a pick-up roller and a separation roller.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
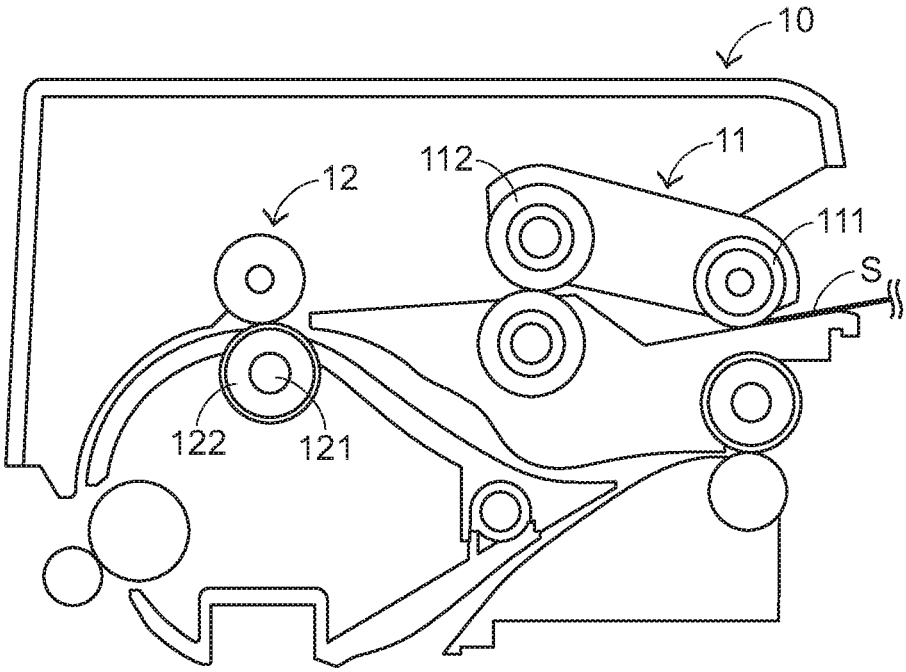
FIG.1 PRIOR ART
FIG. 1 schematically illustrates a conventional automatic document feeder.
Figure 2:
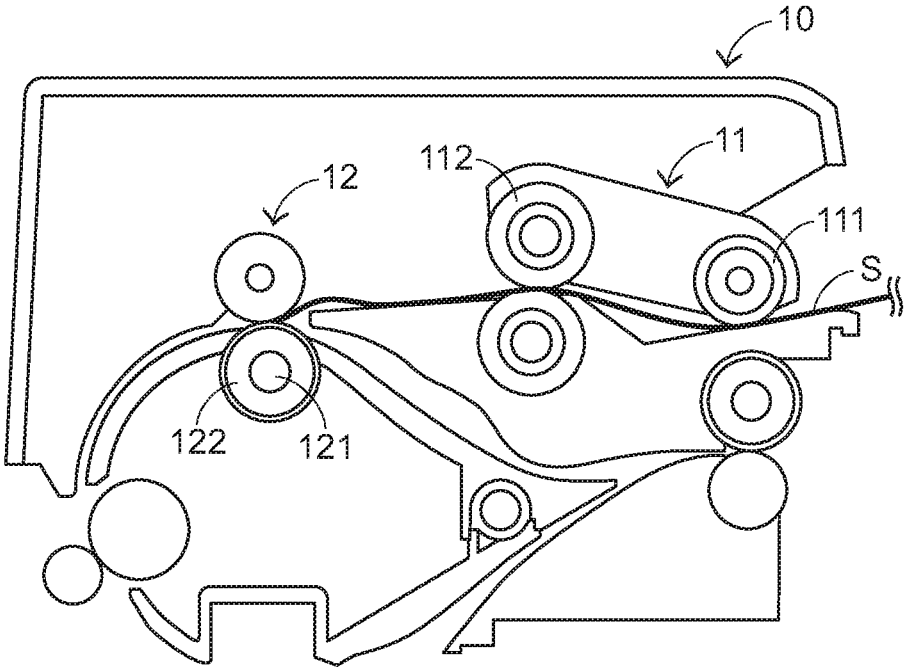
FIG.2 PRIOR ART
FIG. 2 schematically illustrates the actions of the conventional automatic document feeder.
Figure 3:
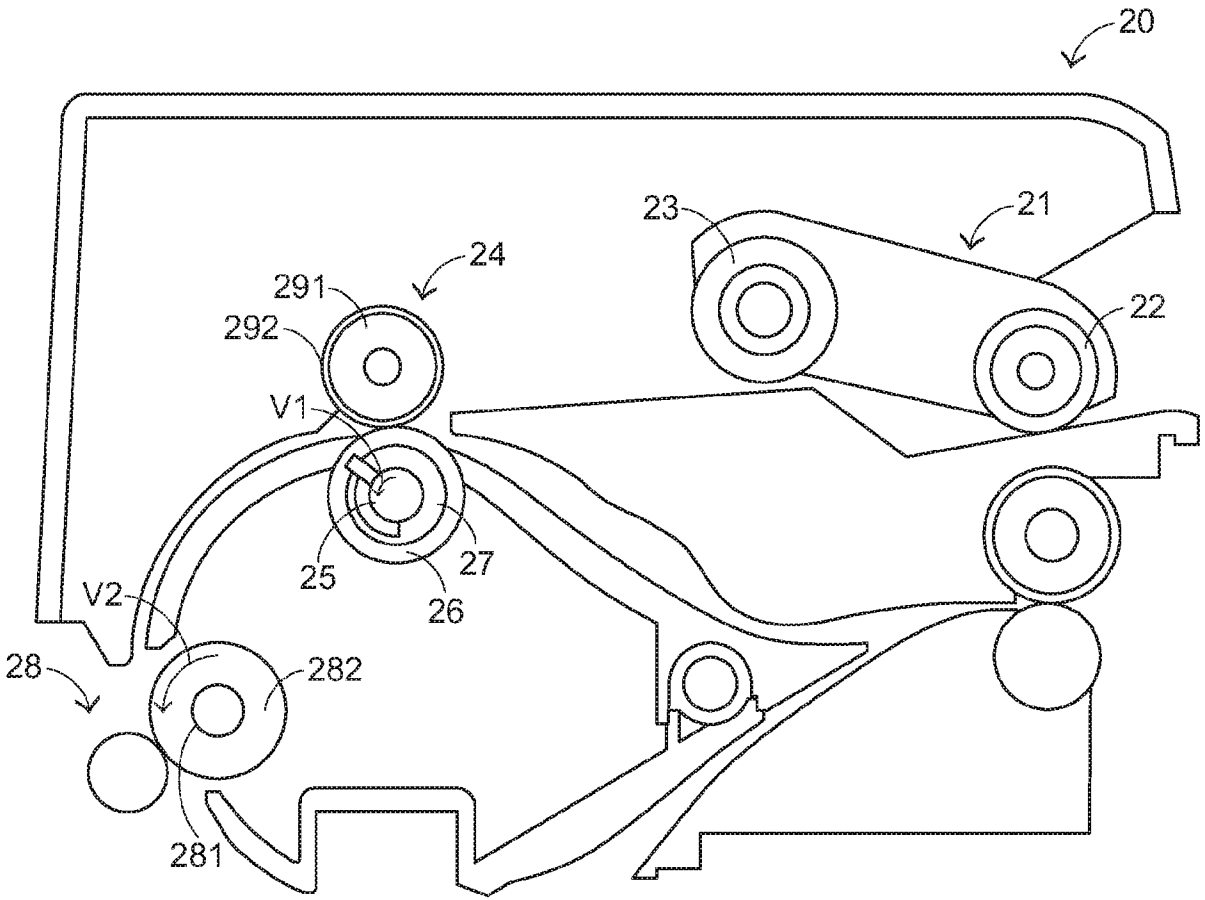
FIG. 3 schematically illustrates an automatic document feeder according to a first embodiment of the present invention.

FIG. 3 schematically illustrates an automatic document feeder according to a first embodiment of the present invention. As shown in FIG. 3, the automatic document feeder 20 comprises a paper pick-up device 21, a first roller assembly 24, a second roller assembly 28, and a power source (not shown). The paper pick-up device 21 is located at a paper entrance. The first roller assembly 24 is located downstream of the paper pick-up device 21. The second roller assembly 28 is located downstream of the first roller assembly 24.

Please refer to FIG. 3 again. The paper pick-up device 21 comprises a pick-up roller 22 and a separation roller 23. The first roller assembly 24 comprises a first shaft 25, a first roller 26, and a power coupling device 27. The second roller assembly 28 comprises a second shaft 281 and a second roller 282. The second roller 282 is sheathed around and connected with the second shaft 281. Consequently, the second roller 282 and the second shaft 281 are synchronously rotated with each other.

The power source is connected with the first shaft 25 and the second shaft 281 for driving the first shaft 25 and the second shaft 281 to be rotated in the same direction. The first shaft 25 is rotated at a first speed V1. The second roller 282 is driven by the second shaft 281 to be rotated at a second speed V2. In this context, the first speed V1 denotes a path length of a particle moving on a shaft surface of the first shaft 25 in a unit time; and the second speed V2 denotes a path length of a particle moving on a roller surface of the second roller 282 in a unit time.

In this embodiment, the automatic document feeder 20 utilizes a single power source to drive the first shaft 25 and the second roller 282. Alternatively, in some embodiments, the first shaft 25 and the second roller 282 are respectively connected with different power sources. That is, the number and connecting way of the power sources are not restricted.

Moreover, for enhancing the stability of moving the papers, the automatic document feeder 20 of the present invention may have two first rollers 26 and two second rollers 282. In such way, during the paper S is transmitted through the first roller assembly 24 and the second roller assembly 28, the force is uniformly exerted on the paper S to reduce the possibility of causing the skewed paper.

Figure 4:
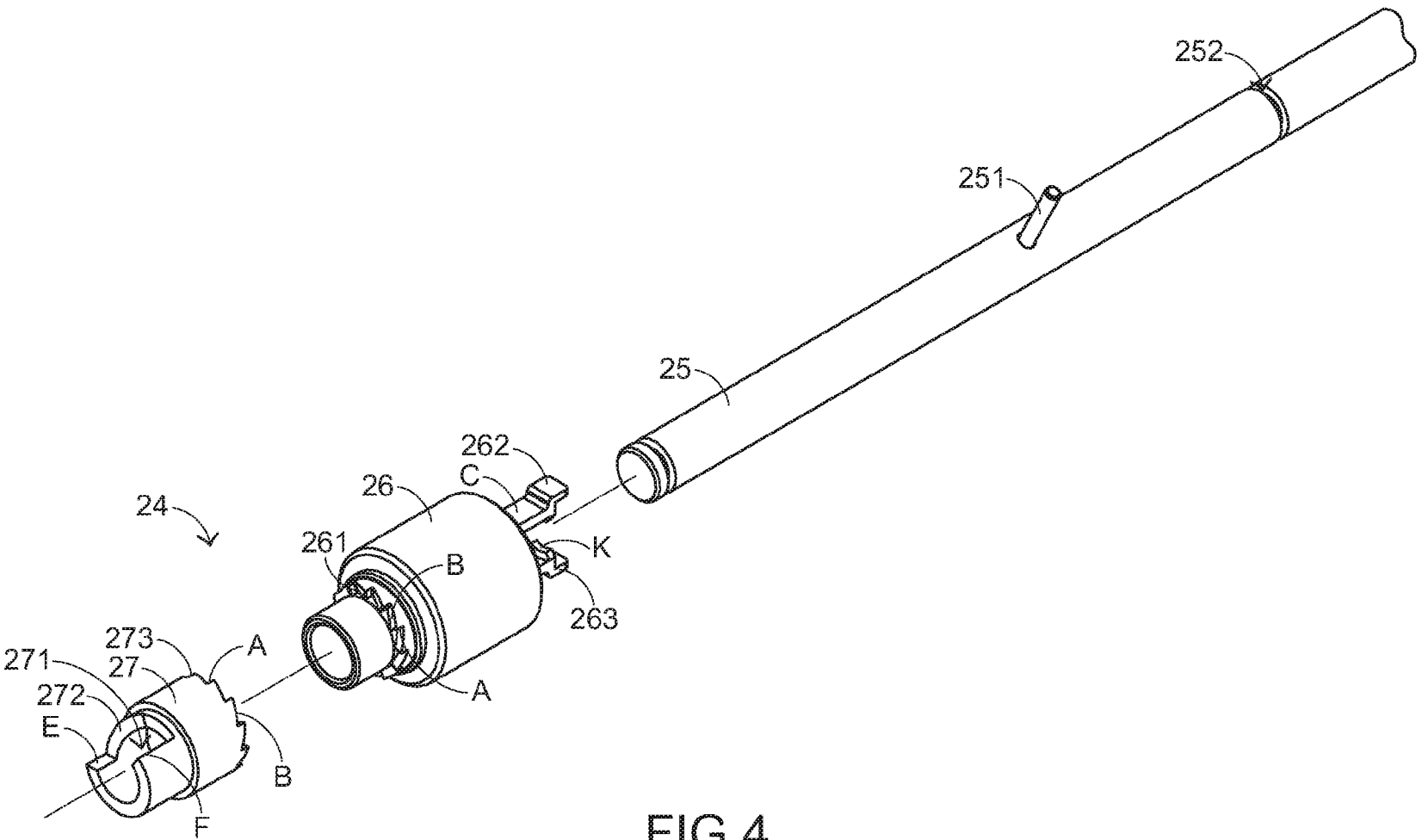
FIG. 4 is a schematic exploded view illustrating the first roller assembly of the automatic document feeder according to the first embodiment of the present invention.

Hereinafter, the configurations of the first roller assembly 24 will be illustrated with reference to FIG. 4. FIG. 4 is a schematic exploded view illustrating the first roller assembly of the automatic document feeder according to the first embodiment of the present invention. As shown in FIG. 4, the first roller assembly 24 comprises the first shaft 25, the first roller 26, and the power coupling device 27. The first roller 26 and the power coupling device 27 are respectively sheathed around the first shaft 25. Moreover, the power coupling device 27 is located at a side of the first roller 26. In this embodiment, the power coupling device 27 is a one-way clutch for establishing or releasing the power connection between the first shaft 25 and the first roller 26.

The first shaft 25 has a protrusion structure 251. A concave structure 271 is located at an end of the power coupling device 27. A beveled guiding surface 272 is located at a first end E of the concave structure 271. The protrusion structure 251 is accommodated within the concave structure 271 to push against the first end E of the concave structure 271.

In this embodiment, the protrusion structure 251 is radially disposed on the first shaft 25. Moreover, the protrusion structure 251 is a protruding post, and integrally formed with the first shaft 25. The concave structure 271 is a notch. In this embodiment, the power coupling device 27 is a one-way spiral jaw clutch. As shown in FIG. 4, the one-way clutch 27 has a first engaging part 273 at a side thereof, and the first roller 26 has a second engaging part 261 at a side thereof. The second engaging part 261 and the first engaging part 273 may be engaged with each other. Moreover, the teeth of first engaging part 273 and the second engaging part 261 are all asymmetric teeth. A first surface A of each asymmetric tooth is parallel with the first shaft 25. In addition, there is an acute angle between the second surface B of the asymmetric tooth and the first surface A of the asymmetric tooth.

In this embodiment, the second engaging part 261 and the first engaging part 273 are completely engaged with each other, and the first side of each asymmetric tooth is parallel with the first shaft 25. It is noted that numerous modifications and alterations may be made while retaining the teachings of the invention. For example, another type of one-way clutch whose first engaging part 273 is incompletely engaged with the second engaging part 261 may be employed. Alternatively, in some embodiments, neither the first surface nor the second surface of the asymmetric tooth is parallel with the first shaft 25, but the one-way clutch is still capable of performing the one-way clutching function.

For preventing from the horizontal movement of the rotating first roller 26 and reducing the adverse influence on the paper-feeding operation, a sliding groove 252 is annularly formed in the surface of the first shaft 25, and two positioning elements 262 and 263 are located at another side of the first roller 26. As shown in FIG. 4, each of the positioning elements 262 and 263 has an extension part C and a raised block K. An end of the extension part C is disposed on the first roller 26. In addition, the extension part C is parallel with the first shaft 25, and extended externally from the first roller 26. The raised block K is disposed on the extension part C, and inserted into the sliding groove 252 of the first shaft 25. Upon rotation of the first roller 26, the raised blocks K of the positioning elements 262 and 263 are slid along the sliding groove 252, thereby positioning the first roller 26.

Figure 5:
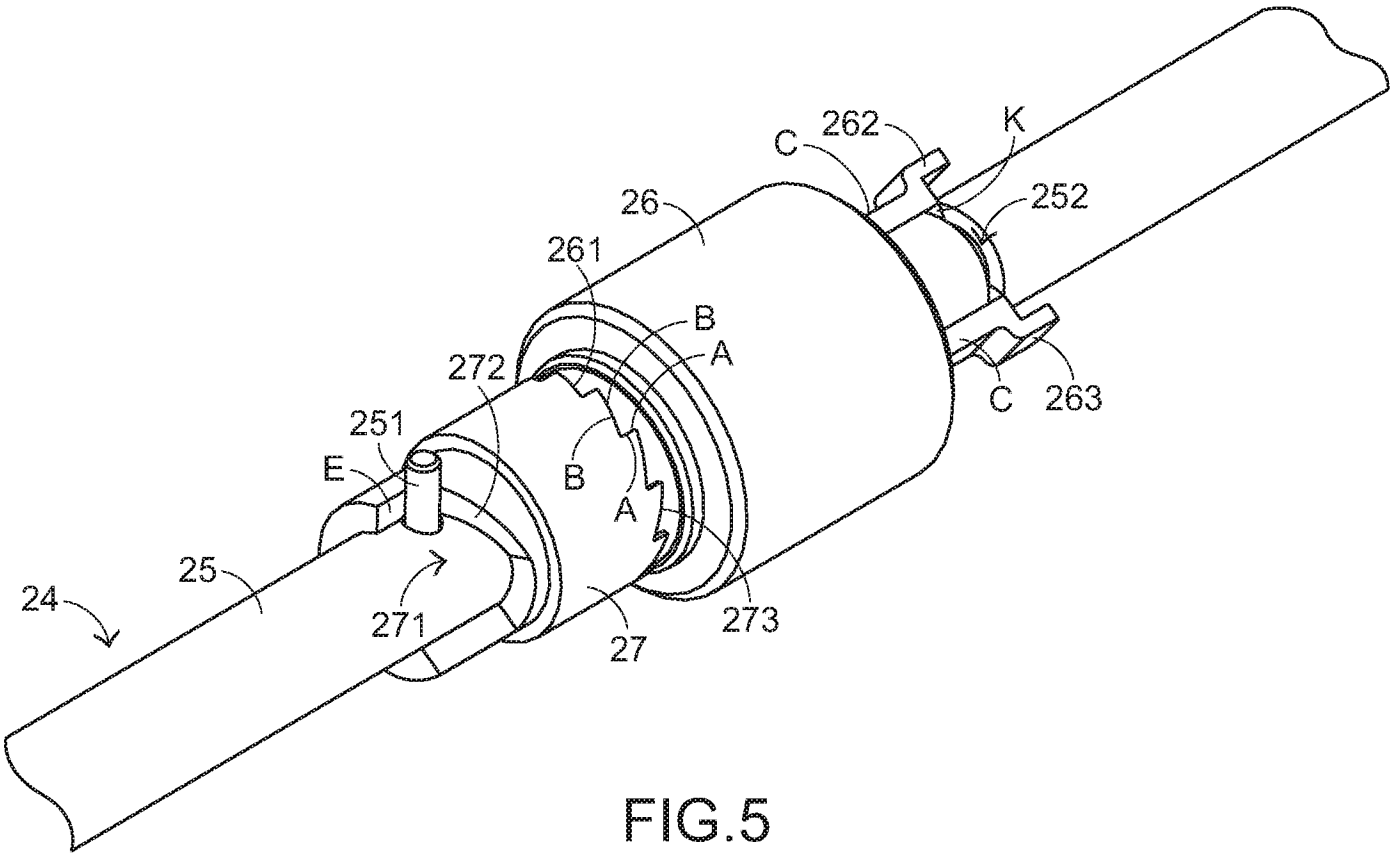
FIGS. 5 and 6 schematically illustrate the actions of the first roller assembly of the automatic document feeder according to the first embodiment of the present invention.
Figure 6:
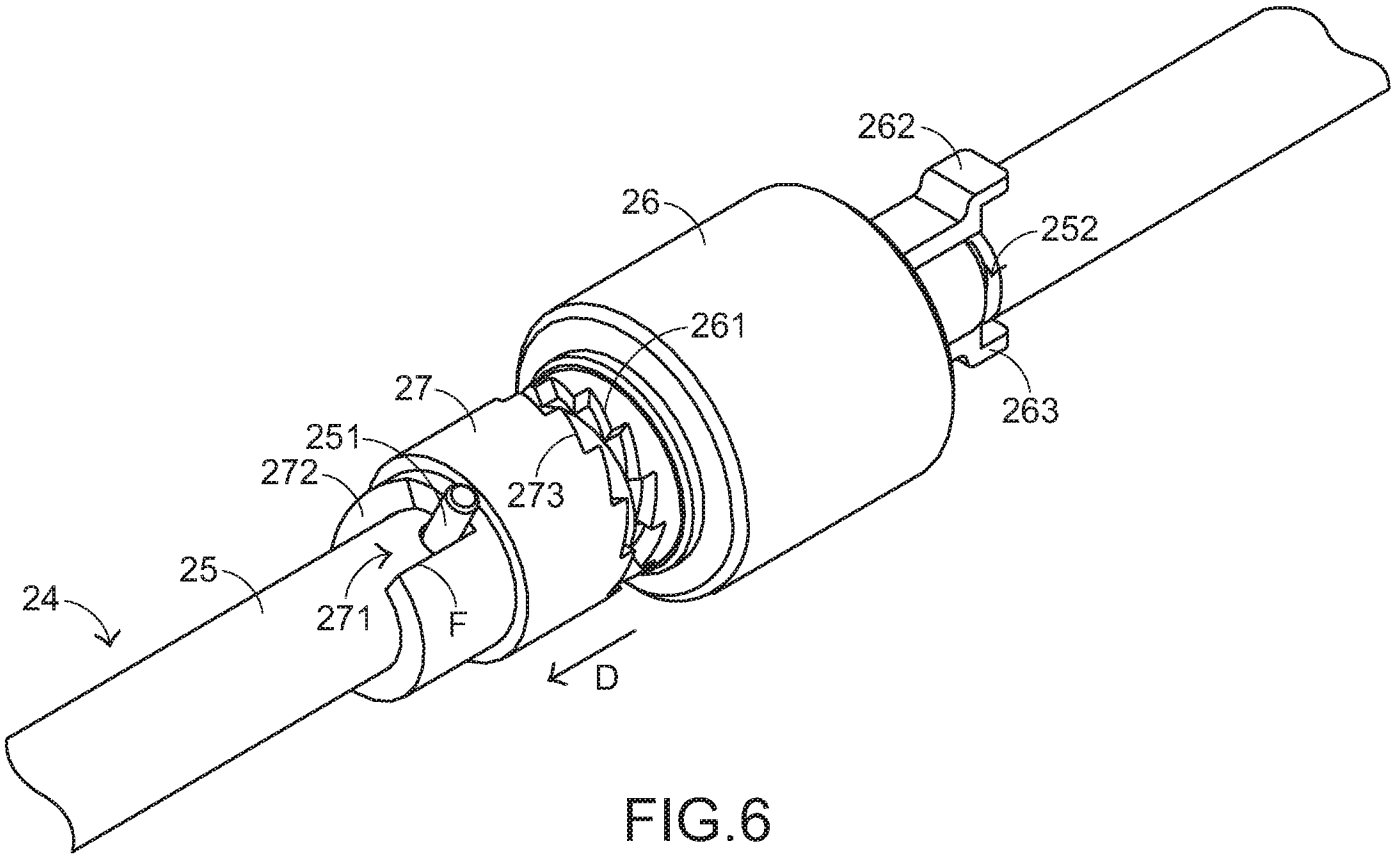

Hereinafter, the actions of the components of the first roller assembly 24 and the paper-feeding operation of the automatic document feeder will be illustrated with reference to FIGS. 5, 6, 7, 8, 9, 10, 11 and 12. FIGS. 5 and 6 schematically illustrate the actions of the first roller assembly of the automatic document feeder according to the first embodiment of the present invention. FIGS. 7~12 schematically illustrate the paper-feeding operation of the automatic document feeder according to the first embodiment of the present invention.

Figure 7:
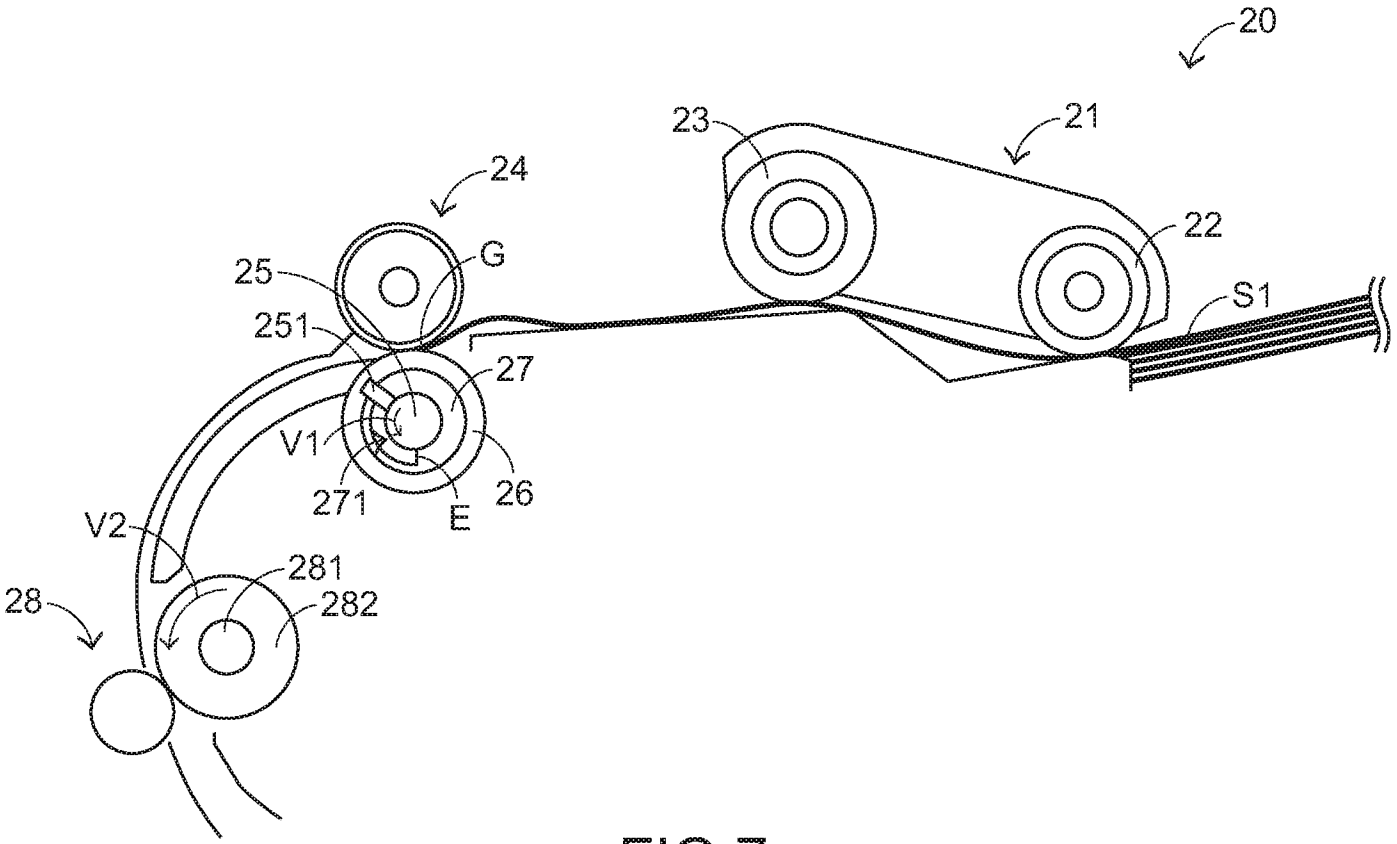
FIGS. 7~12 schematically illustrate the paper-feeding operation of the automatic document feeder according to the first embodiment of the present invention.
Figure 8:
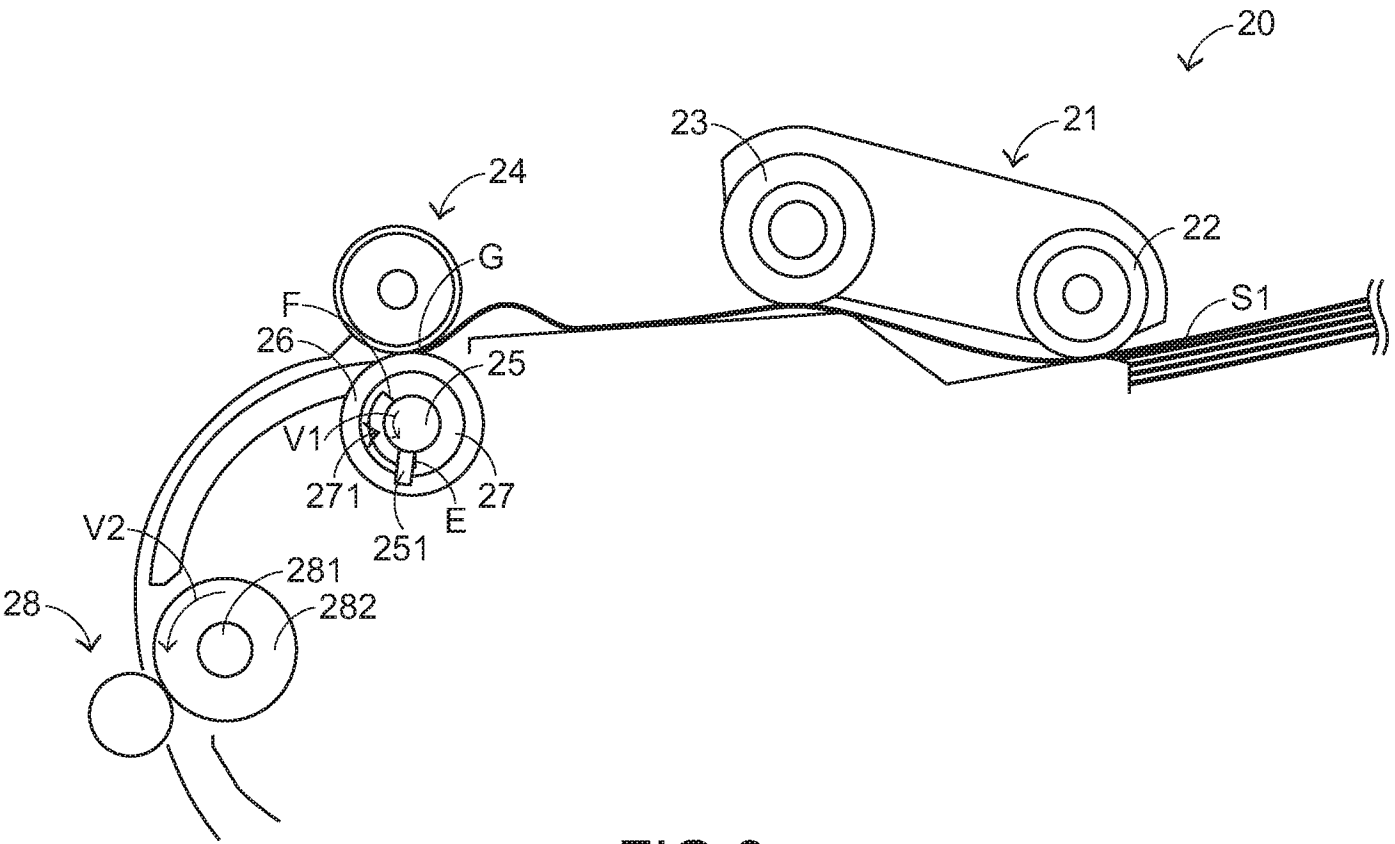

Firstly, as shown in FIG. 7, the pick-up roller 22 is contacted with a paper S1, so that the paper S1 is transmitted into the automatic document feeder 20. The separation roller 22 is located downstream of the pick-up roller 22 for providing a friction force to separate the paper S1, thereby preventing a plurality of papers from being simultaneously fed into the automatic document feeder 20.

Please also refer to FIG. 6. Meanwhile, the first shaft 25 is rotated at the first speed V1. Since the protrusion structure 251 has not been sustained against the first end E of the concave structure 271, the first shaft 25 fails to drive synchronous rotation of the first roller 26 through the power coupling device 27. Under this circumstance, the first roller 26 is in the static status for hindering the paper S1 from being continuously advanced.

Next, the paper S1 is continuously transmitted by the paper pick-up device 21, which is located upstream of the first roller assembly 24. Consequently, the front edge G of the paper S1 is moved to the static first roller 26 and slightly upturned. Then, a preset waiting time is required for allowing the front edge G of the paper S to be completely moved to the first roller 26.

After the preset waiting time, the front edge G of the paper S1 is completely moved to the first roller 26 (see FIG. 8), and the function of correcting the skewed paper S1 is achieved. Meanwhile, the protrusion structure 251 of the first shaft 25 is moved from a second end F of the concave structure 271 toward the first end E of the concave structure 271. Please also refer to FIG. 5. When the protrusion structure 251 is sustained against the first end E of the concave structure 271, the first engaging part 273 of the power coupling device 27 and the second engaging part 261 of the first roller 26 are engaged with each other. Since the first surface A of the asymmetric tooth of the first engaging part 273 is sustained against the first surface A of the asymmetric tooth of the second engaging part 261, the power coupling device 27 becomes a connecting medium between the first shaft 25 and the first roller 26. Meanwhile, the power coupling device 27 is ready to drive rotation of the first roller 26.

Figure 9:
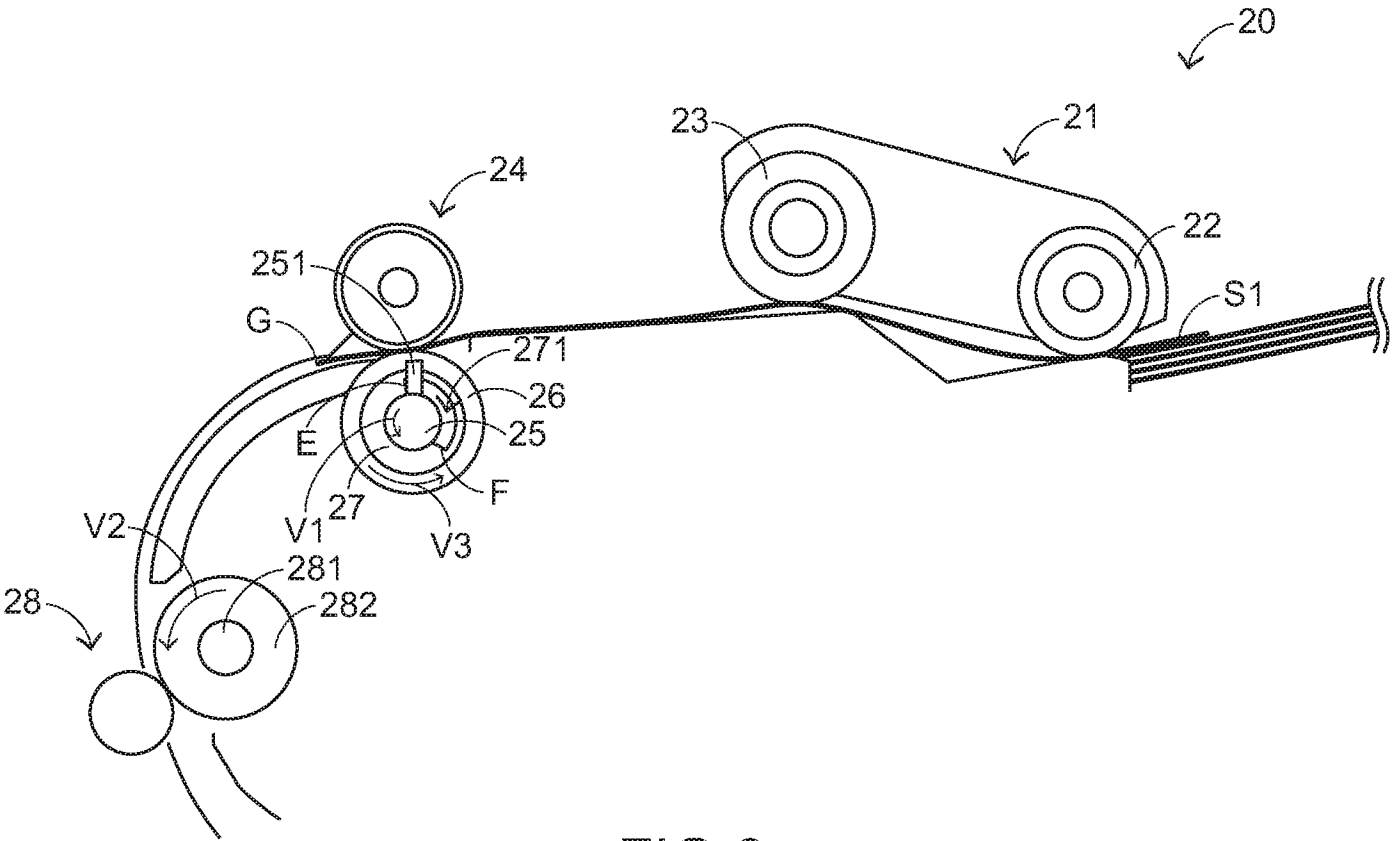

As shown in FIG. 9, the protrusion structure 251 is sustained against the first end E of the concave structure 271, and the first roller 26 is driven to be rotated by the first shaft 25, so that the first roller 26 is rotated at a third speed V3. Meanwhile, the paper S1 originally hindered by the first roller 26 is transmitted by the first roller 26 (at the third speed V3) to the second roller assembly 28, which is rotated at the second speed V2. The third speed V3 is lower than the second speed V2. Similarly, the third speed V3 denotes a path length of a particle moving on a roller surface of the first roller 26 in a unit time.

Figure 10:
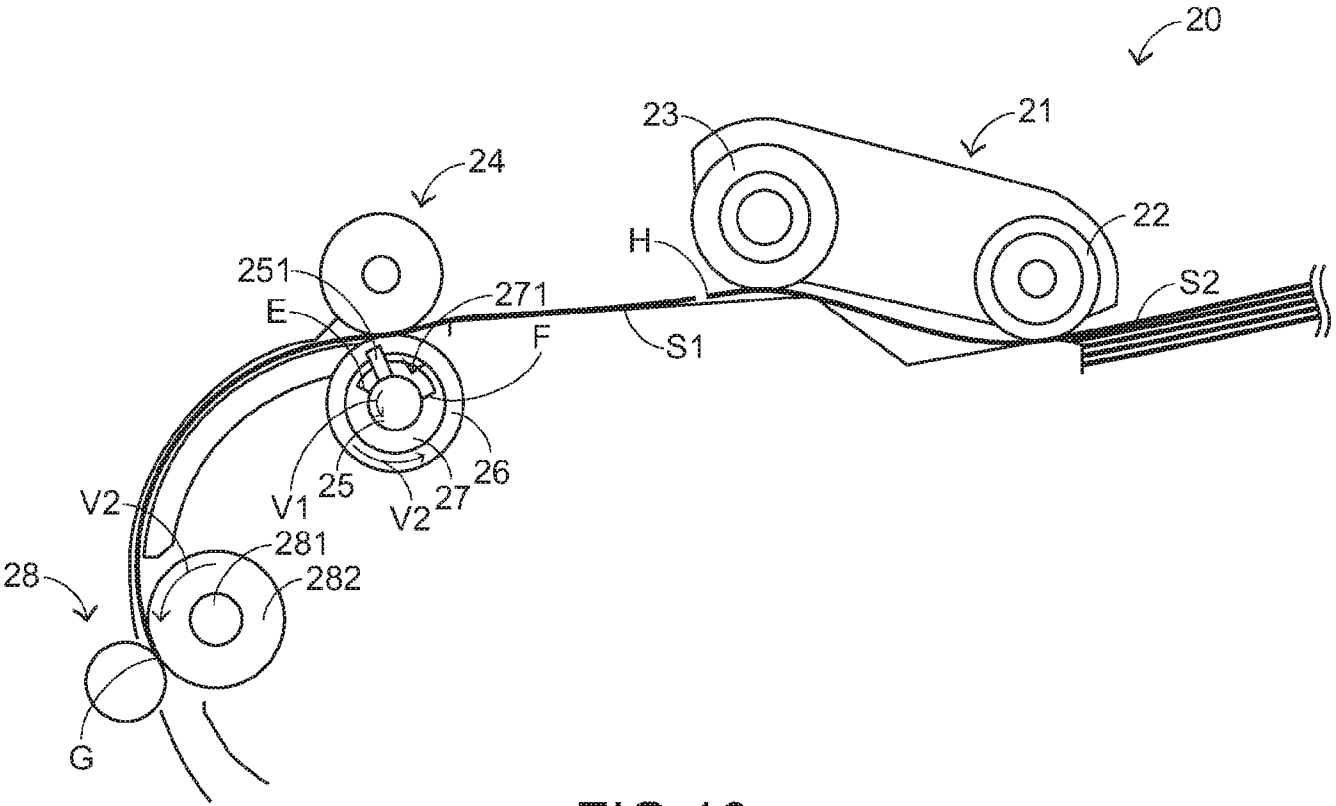

As shown in FIG. 10, the front edge G of the paper S1 is moved to the second roller 282 of the second roller assembly 28, and the paper S1 has not been completely departed from the first roller 26, the paper S1 is transmitted by the second roller 282. Meanwhile, the speed of moving the paper S1 is switched from the third speed V3 to the second speed V2. In addition, the first roller 26 is driven to be rotated at the second speed V2.

Please refer to FIGS. 5 and 6 again. When the first roller 26 is rotated at the second speed V2 higher than third speed V3, the client-server relationship between the power coupling device 27 and the first roller 26 is exchanged. Originally, the first engaging part 273 is sustained against the second engaging part 261. Meanwhile, the second engaging part 261 is sustained against the first engaging part 273. Consequently, the first roller 26 is driven to be rotated by the power coupling device 27. Under this circumstance, the power connection between the first roller 26 and the first shaft 25 is released by the power coupling device 27.

Meanwhile, the angular change of the first shaft 25 which is rotated at the first speed V1 is obviously lower than the angular change of the first roller 26 which is rotated at the second speed V2. Consequently, the protrusion structure 251 is gradually moved from the first end E of the concave structure 271 toward the second end F of the concave structure 271.

Since the power coupling device 27 is no longer pushed by the protrusion structure 251, the power coupling device 27 can be freely shifted in the horizontal direction. In addition, since the second surface B of the asymmetric tooth of the second engaging part 261 is sustained against the second surface B of the asymmetric tooth of the first engaging part 273, a horizontal component force is continuously provided to the power coupling device 27. Consequently, as shown in FIG. 6, the power coupling device 27 is moved along the beveled guiding surface 272 of the concave structure 271 in a direction D away from the first roller 26. Under this circumstance, the first engaging part 273 is no longer engaged with the second engaging part 261, so that the power coupling device 27 is in an idle running status. After the external force acting on the first roller 26 is eliminated (i.e. the paper S1 is completely departed from the first roller 26), the first roller 26 loses the motive power, so that the first roller 26 reaches the static status.

On the other hand, after the power coupling device 27 is in the idle running status, the protrusion structure 251 reaches the second end F of the concave structure 271 to result in a braking effect. Consequently, the speed of the power coupling device 27 is lowered down. Meanwhile, the first shaft 25 is still rotated at the first speed V1, and the protrusion structure 251 is gradually moved from the second end F of the concave structure 271 toward the first end E of the concave structure 271. As shown in FIG. 5, when the protrusion structure 251 is sustained against the first end E of the concave structure 271 again, the power coupling device 27 approaches the first roller 26. Consequently, the first engaging part 273 is engaged with the second engaging part 261 again. Meanwhile, the power coupling device 27 is driven to be rotated by the first shaft 25 through the protrusion structure 251, and the first roller 26 is driven to be rotated at the third speed V3.

Figure 11:
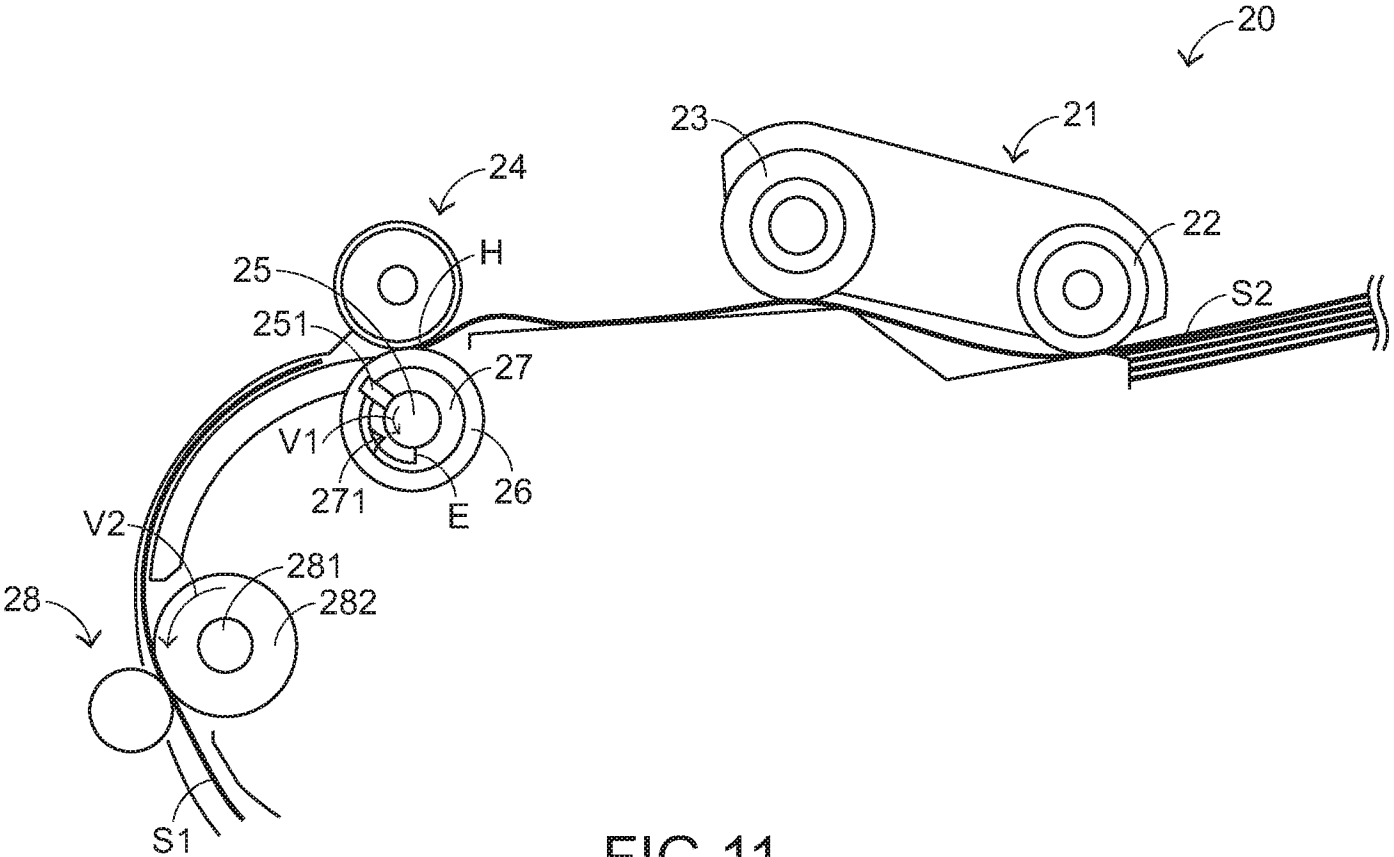
Figure 12:
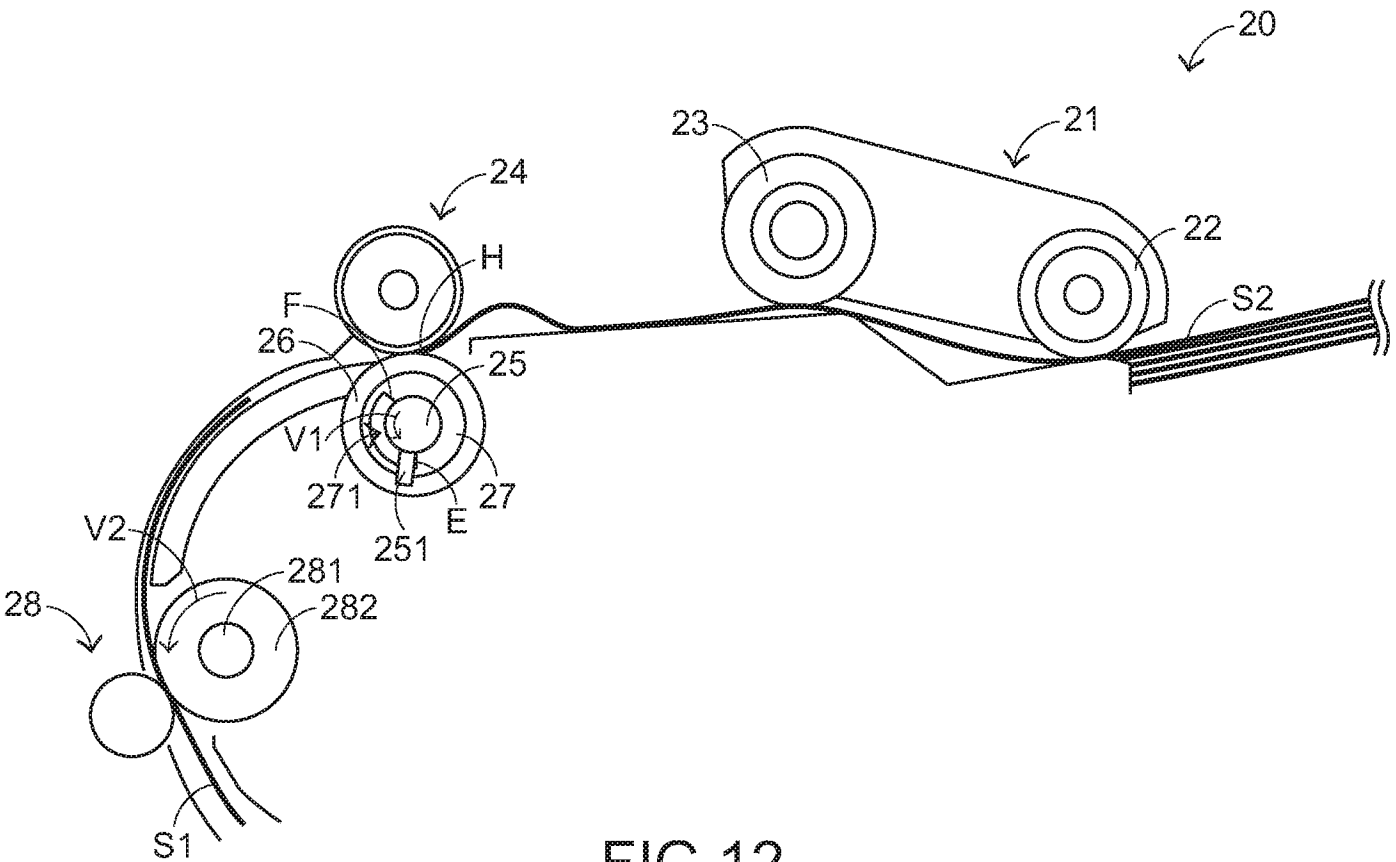

After the paper S1 is completely departed from the first roller 26, the external force acting on the first roller 26 is eliminated, so that the first roller 26 reaches the static status (see FIG. 11). Meanwhile, a next paper S2 is hindered by the static first roller 26 from being advanced again, so that the skew phenomenon of the next paper S2 can be corrected. Until the protrusion structure 251 is sustained against the first end E of the concave structure 271 again (see FIG. 12), the front edge H of the next paper S2 is allowed to pass through the first roller 26.

In this embodiment, the first roller assembly 24 further comprises an idle roller 291 and an anti-slip cover 292 (see FIG. 3) in order to facilitate the first roller 26 to quickly reach the static status. As shown in FIG. 3, the idle roller 291 is disposed over the first roller 26, and the anti-slip cover 292 is disposed on the surface of the idle roller 291. After the paper is completely departed from the first roller assembly 24, the first roller 26 is directly contacted with the anti-slip cover 292, so that a friction force is generated. Due to the friction force, the speed of the first roller 26 is quickly lowered down, and the first roller 26 can quickly reach the static status.

Figure 13:
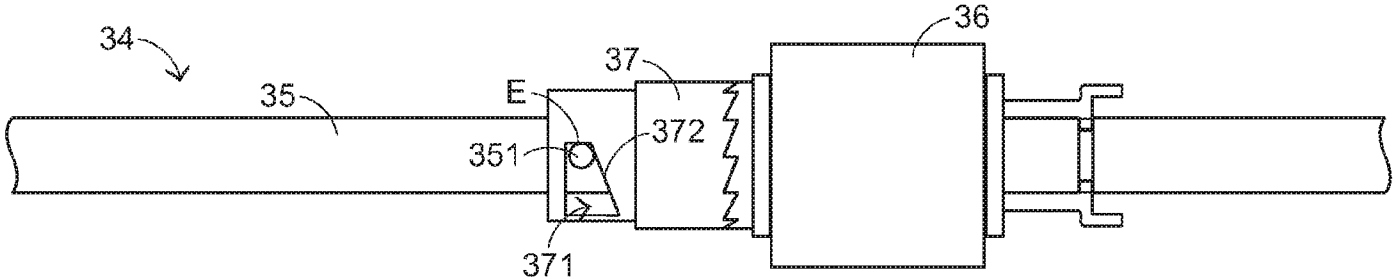
FIG. 13 schematically illustrates the first roller assembly of an automatic document feeder according to a second embodiment of the present invention.

FIG. 13 schematically illustrates the first roller assembly of an automatic document feeder according to a second embodiment of the present invention. As shown in FIG. 13, the first roller assembly 34 comprises a first shaft 35, a first roller 36, and a power coupling device 37. The first roller 36 and the power coupling device 37 are respectively sheathed around the first shaft 35. Moreover, the power coupling device 37 is located at a side of the first roller 36. In this embodiment, the power coupling device 37 is a one-way clutch for establishing or releasing the power connection between the first shaft 35 and the first roller 36.

The first shaft 35 has a protrusion structure 351. A concave structure 371 is located at an end of the power coupling device 37. A beveled guiding surface 372 is located at a first end E of the concave structure 371. The protrusion structure 351 is accommodated within the concave structure 371 to push against the first end E of the concave structure 371.

Except for the following items, the configurations and operations of the first roller assembly of the second embodiment are substantially identical to those of the first embodiment of FIG. 4. For example, the concave structure 371 of the power coupling device 37 is a close slot rather than the open notch. In addition, the protrusion structure 351 is a protruding post, which is radially inserted in the first shaft 35. On the other hand, the protrusion structure 351 is not integrally formed with the first shaft 35. It is noted that numerous modifications and alterations of arranging the protrusion structure 351 may be made while retaining the teachings of the invention. For example, the protrusion structure 351 may be fastened or adhered on the first shaft 35 through an additional connecting element.

Figure 14:
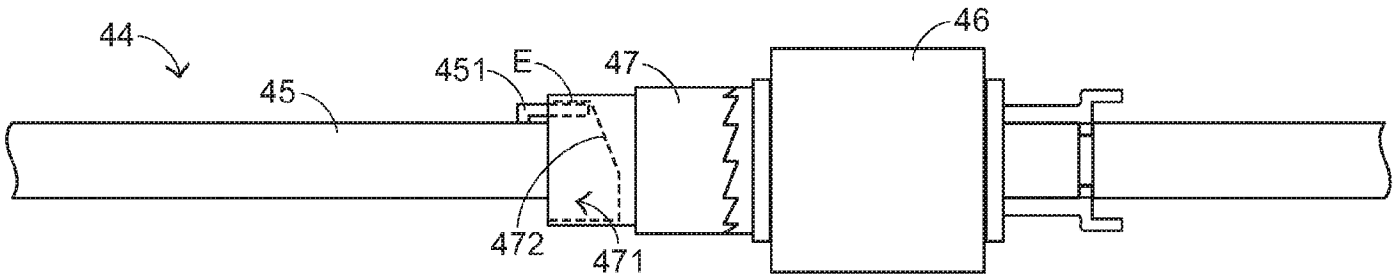
FIG. 14 schematically illustrates the first roller assembly of an automatic document feeder according to a third embodiment of the present invention.

FIG. 14 schematically illustrates the first roller assembly of an automatic document feeder according to a third embodiment of the present invention. As shown in FIG. 14, the first roller assembly 44 comprises a first shaft 45, a first roller 46, and a power coupling device 47. The first roller 46 and the power coupling device 47 are respectively sheathed around the first shaft 45. Moreover, the power coupling device 47 is located at a side of the first roller 46. In this embodiment, the power coupling device 47 is a one-way clutch for establishing or releasing the power connection between the first shaft 45 and the first roller 46.

The first shaft 45 has a protrusion structure 451. A concave structure 471 is located at an end of the power coupling device 47. A beveled guiding surface 472 is located at a first end E of the concave structure 471. The protrusion structure 451 is accommodated within the concave structure 471 to push against the first end E of the concave structure 471.

Except for the following items, the configurations and operations of the first roller assembly of the third embodiment are substantially identical to those of the second embodiment of FIG. 13. For example, the protrusion structure 451 is parallel with the first shaft 45, but the protrusion structure 451 of the first shaft 45 is not radially inserted in the first shaft 45. It is noted that numerous modifications and alterations of arranging the protrusion structure 451 may be made while retaining the teachings of the invention. For example, the protrusion structure 451 may be integrally formed with or inserted in the first shaft 45.

Figure 15:
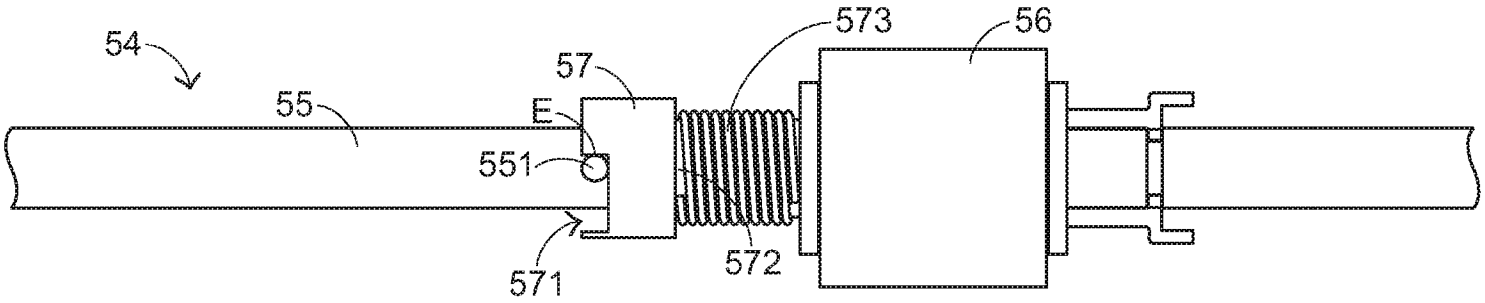
FIG. 15 schematically illustrates the first roller assembly of an automatic document feeder according to a fourth embodiment of the present invention.

FIG. 15 schematically illustrates the first roller assembly of an automatic document feeder according to a fourth embodiment of the present invention. As shown in FIG. 15, the first roller assembly 54 comprises a first shaft 55, a first roller 56, and a power coupling device 57. The first roller 56 and the power coupling device 57 are respectively sheathed around the first shaft 55. Moreover, the power coupling device 57 is located at a side of the first roller 56. In this embodiment, the power coupling device 57 is a one-way clutch for establishing or releasing the power connection between the first shaft 55 and the first roller 56.

The first shaft 55 has a protrusion structure 551. A concave structure 571 is located at an end of the power coupling device 57. The protrusion structure 551 is accommodated within the concave structure 571 to push against the first end E of the concave structure 571.

In this embodiment, the protrusion structure 551 is radially disposed on the first shaft 55. Moreover, the protrusion structure 551 is a protruding post, which is integrally formed with the first shaft 55. The concave structure 571 is a notch. In this embodiment, the power coupling device 57 is a one-way spring clutch. As shown in FIG. 15, the one-way clutch comprises a bearing 572 and a spring 573. A first end of the spring 573 is connected with the bearing 572. A second end of the spring 573 is connected with the first roller 56 for providing a damping torque to the first roller 56.

Except for the following items, the configurations and operations of the first roller assembly of the second embodiment are substantially identical to those of the first embodiment of FIG. 4. For example, the power coupling device 57 is the one-way spring clutch rather than the one-way spiral jaw clutch.

Figure 16:
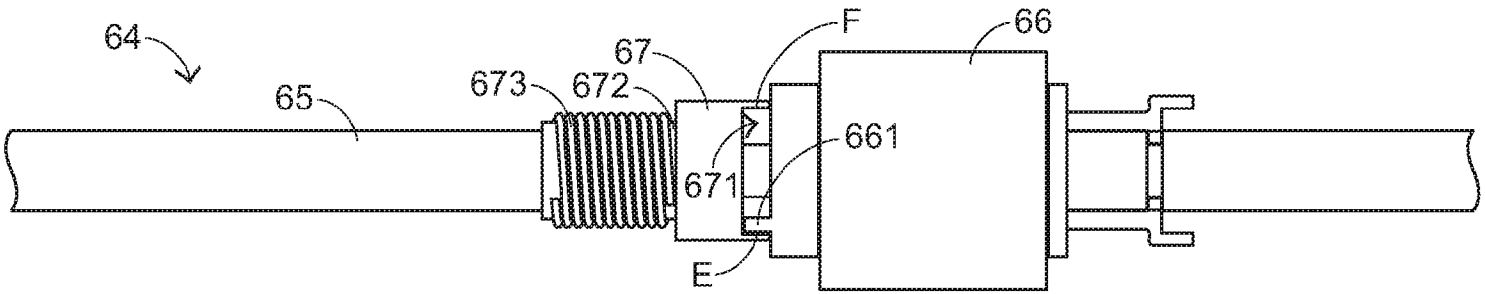
FIG. 16 schematically illustrates the first roller assembly of an automatic document feeder according to a fifth embodiment of the present invention.

FIG. 16 schematically illustrates the first roller assembly of an automatic document feeder according to a fifth embodiment of the present invention. As shown in FIG. 16, the first roller assembly 64 comprises a first shaft 65, a first roller 66, and a power coupling device 67. The first roller 66 and the power coupling device 67 are respectively sheathed around the first shaft 65. Moreover, the power coupling device 67 is located at a side of the first roller 66. In this embodiment, the power coupling device 67 is a one-way clutch for establishing or releasing the power connection between the first shaft 65 and the first roller 66.

The first roller 66 has a protrusion structure 661. A concave structure 671 is located at an end of the power coupling device 67. The protrusion structure 661 is accommodated within the concave structure 671 to push against a first end E of the concave structure 671.

In this embodiment, the protrusion structure 661 is axially disposed on the first roller 66. Moreover, the protrusion structure 661 is a protruding post, which is integrally formed with the first roller 66. The concave structure 671 is a notch. In this embodiment, the power coupling device 67 is a one-way spring clutch. As shown in FIG. 16, the one-way clutch comprises a bearing 672 and a spring 673. A first end of the spring 673 is connected with the bearing 672. A second end of the spring 673 is connected with the first shaft 65 for providing a damping torque to the first shaft 65.

Except for the following items, the configurations and operations of the first roller assembly of the fifth embodiment are substantially identical to those of the fourth embodiment of FIG. 15. For example, the locations of the protrusion structure 661, the concave structure 671 and the spring 673 are distinguished.

Figure 17:
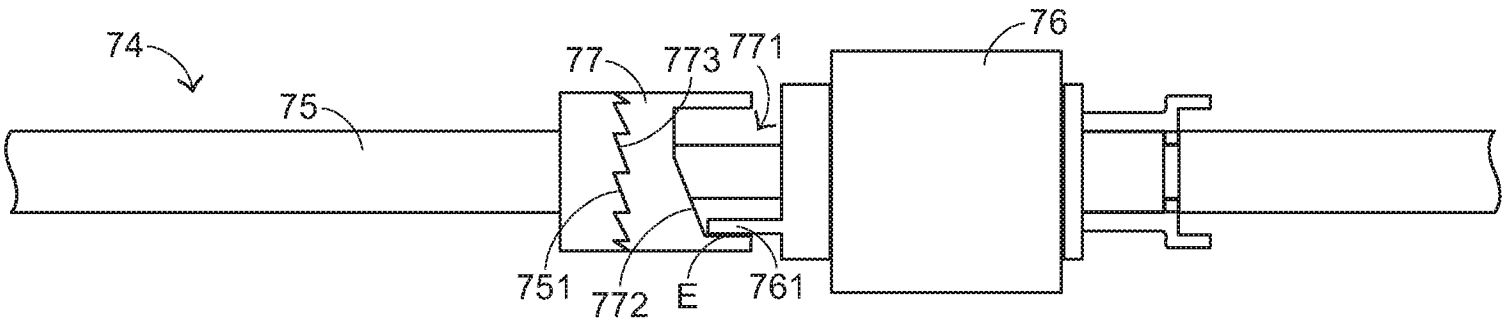
FIG. 17 schematically illustrates the first roller assembly of an automatic document feeder according to a sixth embodiment of the present invention.

FIG. 17 schematically illustrates the first roller assembly of an automatic document feeder according to a sixth embodiment of the present invention. As shown in FIG. 17, the first roller assembly 74 comprises a first shaft 75, a first roller 76, and a power coupling device 77. The first roller 76 and the power coupling device 77 are respectively sheathed around the first shaft 75. Moreover, the power coupling device 77 is located at a side of the first roller 76. In this embodiment, the power coupling device 77 is a one-way clutch for establishing or releasing the power connection between the first shaft 75 and the first roller 76.

The first roller 76 has a protrusion structure 761. A concave structure 771 is located at an end of the power coupling device 77. A beveled guiding surface 772 is located at a first end E of the concave structure 771. The protrusion structure 761 is accommodated within the concave structure 771 to push against the first end E of the concave structure 771.

In this embodiment, the protrusion structure 761 is axially disposed on the first roller 76. Moreover, the protrusion structure 761 is a protruding post, which is integrally formed with the first roller 76. The concave structure 771 is a notch. In this embodiment, the power coupling device 77 is a one-way spiral jaw clutch. As shown in FIG. 17, the one-way clutch has a first engaging part 773 at a side thereof, and the first shaft 75 has a second engaging part 751 at a side thereof. The second engaging part 751 and the first engaging part 773 are engaged with each other. Moreover, the teeth of first engaging part 773 and the second engaging part 751 are all asymmetric teeth.

In this embodiment, the second engaging part 751 and the first engaging part 773 are completely engaged with each other, and the first side of each asymmetric tooth is parallel with the first shaft 75. It is noted that numerous modifications and alterations may be made while retaining the teachings of the invention. For example, another type of one-way clutch whose first engaging part 773 is incompletely engaged with the second engaging part 751 may be employed. Alternatively, in some embodiments, neither the first surface nor the second surface of the asymmetric tooth is parallel with the first shaft 75, but the one-way clutch is still capable of performing the one-way clutching function.

Except for the following items, the configurations and operations of the first roller assembly of the sixth embodiment are substantially identical to those of the first embodiment of FIG. 4. For example, the locations of the first engaging part 773, second engaging part 751, the protrusion structure 761 and the concave structure 771 are distinguished.

From the above embodiments, the automatic document feeder of the present invention comprises a paper pick-up device, a first roller assembly, and a second roller assembly. The first roller assembly comprises a first shaft, a first roller, and a power coupling device. The first roller and the power coupling device are respectively sheathed around the first shaft. Moreover, the power coupling device is located at a side of the first roller.

When the power coupling device is connected with the first shaft and the first roller, the first roller is driven to be rotated at a third speed by the first shaft, so that the first roller has the function of transmitting the paper. When the first roller is driven to be rotated at the second speed by the paper, the power connection between the first roller and the first shaft is released by the power coupling device. After the paper is completely departed from the first roller and during the power connection between the first shaft and first roller is established again, the first roller reaches a static status. Consequently, the first roller has the function of correcting the skewed paper.

From the above description, the present invention provides an automatic document feeder. Due to the speed difference between the first roller assembly and the second roller assembly and the arrangement of the power coupling device, the power connection between the first shaft and the first roller is selectively established or released. Consequently, without the need of changing the speed of the first roller, the first roller is still in the static status in the initial stage of feeding the paper to correct the skewed paper. In such design, the paper skew problem can be effectively solved. Moreover, the time period for accelerating the shaft from the static state to the normal speed can be saved. Consequently, the automatic document feeder of the present invention has enhanced paper-feeding efficiency and reduced operating time.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder, comprising:

a paper pick-up device for transmitting a paper into said automatic document feeder;

a first roller assembly located downstream of said paper pick-up device for transmitting said paper, and comprising:

a first shaft rotated at a first speed;

a first roller sheathed around said first shaft for transmitting said paper; and a power coupling device located at a side of said first roller, wherein said first shaft has a protrusion structure, and said power coupling device has a concave structure, wherein said protrusion structure is accommodated within said concave structure, and wherein said concave structure has a slot; and a second roller assembly located downstream of said first roller assembly for transmitting said paper, and comprising:

a second shaft; and a second roller sheathed around said second shaft, and driven to be rotated at a second speed by said second shaft, thereby transmitting said paper, wherein when said power coupling device is connected with said first shaft and said first roller, said first roller is driven to be rotated at a third speed by said first shaft, so that said paper is transmitted to said second roller, wherein said third speed is lower than said second speed, wherein when a front edge of said paper is moved to said second roller and said paper has not been completely departed from said first roller, said first roller is driven to be rotated at said second speed by said paper, so that a power connection between said first roller and said first shaft is released by said power coupling device, wherein after said paper is completely departed from said first roller and while said power connection between said first shaft and first roller is released, said first roller reaches a static status.

2. The automatic document feeder according to claim 1 wherein said power coupling device is a one-way clutch.

3. The automatic document feeder according to claim 2 wherein said one-way clutch has a first engaging part, and said first roller has a second engaging part, wherein said first engaging part and said second engaging part are engaged with each other.

4. The automatic document feeder according to claim 2 wherein said one-way clutch has a first engaging part, and said first shaft has a second engaging part, wherein said first engaging part and said second engaging part are engaged with each other.

5. The automatic document feeder according to claim 2 wherein said one-way clutch comprises a bearing and a spring, wherein a first end of said spring is connected with said bearing, and a second end of said spring is connected with said first roller.

6. The automatic document feeder according to claim 2 wherein said one-way clutch comprises a bearing and a spring, wherein a first end of said spring is connected with said bearing, and a second end of said spring is connected with said first shaft.

7. The automatic document feeder according to claim 1 wherein said protrusion structure is a protruding post.

8. The automatic document feeder according to claim 1 wherein said protrusion structure is integrally formed with said first shaft.

9. The automatic document feeder according to claim 1 wherein said protrusion structure is inserted in said first shaft.

10. The automatic document feeder according to claim 1 wherein said paper pick-up device comprises a pick-up roller and a separation roller.

* * * * *